United States Patent [19]

Sumigawa

[11] Patent Number: 5,018,995

[45] Date of Patent: May 28, 1991

[54] TILT HANDLE

[75] Inventor: Yukio Sumigawa, Hamamatsu, Japan

[73] Assignee: Sanshin Kogyo Kabushiki Kaisha, Hamamatsu, Japan

[21] Appl. No.: 363,475

[22] Filed: Jun. 8, 1989

[30] Foreign Application Priority Data

Jun. 10, 1988 [JP] Japan ..... 63-141811

[51] Int. Cl.[5] ..... B63H 5/12

[52] U.S. Cl. ..... 440/63; 440/53

[58] Field of Search ..... 440/53, 63, 76, 77, 440/900; 123/195 P

[56] References Cited

U.S. PATENT DOCUMENTS

| | | | |
|---|---|---|---|
| 2,948,252 | 8/1960 | Alexander | 440/77 |
| 3,171,382 | 3/1965 | Bergstedt | 440/76 |
| 3,295,490 | 1/1967 | Hiatt | 440/38 |
| 3,426,723 | 2/1969 | Specht | 440/63 |
| 3,461,832 | 8/1969 | Vierling | 440/63 |
| 4,559,018 | 12/1985 | Nakahama et al. | 440/53 |

FOREIGN PATENT DOCUMENTS

| | | | |
|---|---|---|---|
| 982545 | 1/1976 | Canada | 440/63 |
| 57-30697 | 6/1981 | Japan . | |
| 58-33596 | 8/1981 | Japan . | |
| 0157694 | 12/1981 | Japan | 440/77 |
| 0047796 | 3/1985 | Japan | 440/53 |

*Primary Examiner*—Ed Swinehart

*Attorney, Agent, or Firm*—Ernest A. Beutler

[57] ABSTRACT

A tilt handle which is secured to the power head of an outboard drive unit on a marine vessel for moving the drive unit through a small tilt angle from a tilted-down position in which the drive unit propeller is below the surface of the water to a tilted-up position in which the propeller is out of the water. The drive unit includes an elongated swivel bracket which places the power head a substantial distance from the vessel when running. On such a drive unit, the tilt handle assists in the tilting up operation and permits the power head to be positioned near the vessel for easy operation and maintenance by the driver of the vessel.

17 Claims, 5 Drawing Sheets

TILT HANDLE

BACKGROUND OF THE INVENTION

The invention relates to a tilt handle for an outboard drive unit, such as an outboard engine or the outboard drive portion of an inboard/outboard engine system, for boats, rafts and other marine vessels that permits tilting of the drive unit for easy maintenance and operation by the driver of the outboard drive unit.

One form of an outboard drive unit is attached to the hull of a marine vessel by a clamp bracket and an elongated rearwardly extending swivel bracket pivotally secured to the clamp bracket by a tilt shaft. Such an elongated swivel bracket provides the following advantages: it allows the drive unit to be selectively tilted downwardly into, or upwardly out of, the water through a small tilt angle. In addition, when the drive unit is in the tilted up position, the power head of the drive unit does not intrude into the vessel. Such an elongated swivel bracket also allows the drive unit to be positioned away from the vessel, thereby improving the propulsion efficiency. This type of elongated swivel bracket is normally used on vessels having a high transom such as a sail boat. However, this type of elongated swivel bracket places a substantial distance from the hull when running which makes starting and servicing difficult. Therefore, it is the practice to tilt up the power head of the drive unit for starting and maintenance of the drive unit. This, of course, is difficult with conventional constructions.

SUMMARY CF THE INVENTION

A tilt handle secured to an outboard drive unit pivotally attached to the hull of a marine vessel for moving the drive unit through a small tilt angle between a tilted-down position wherein the propeller of the drive unit is positioned beneath the water and a tilted up position wherein the propeller is out of water but the power head of the drive unit does not intrude into the vessel. Preferably, the outboard drive unit includes a clamp bracket attached to the hull of the marine vessel, a tilt shaft, and a swivel bracket pivotally secured to the clamp bracket by the tilt shift for movement of the outboard drive unit. In accordance with the invention a tilt handle is provided on the power head to assist in the tilting up operation.

DETAIIED DESCRIPTION OF THE PREFERRED EMBODIMENT

For purposes of describing and illustrating the principles and function of the invention, the drawings illustrate an outboard engine unit, generally referred to herein as a drive unit. The invention is not so limited, however, as it is equally applicable to vessels having inboard engines with outboard drive apparatus as well as other vessels having drive configurations capable of trim adjustment and tilting up.

Figure 1:
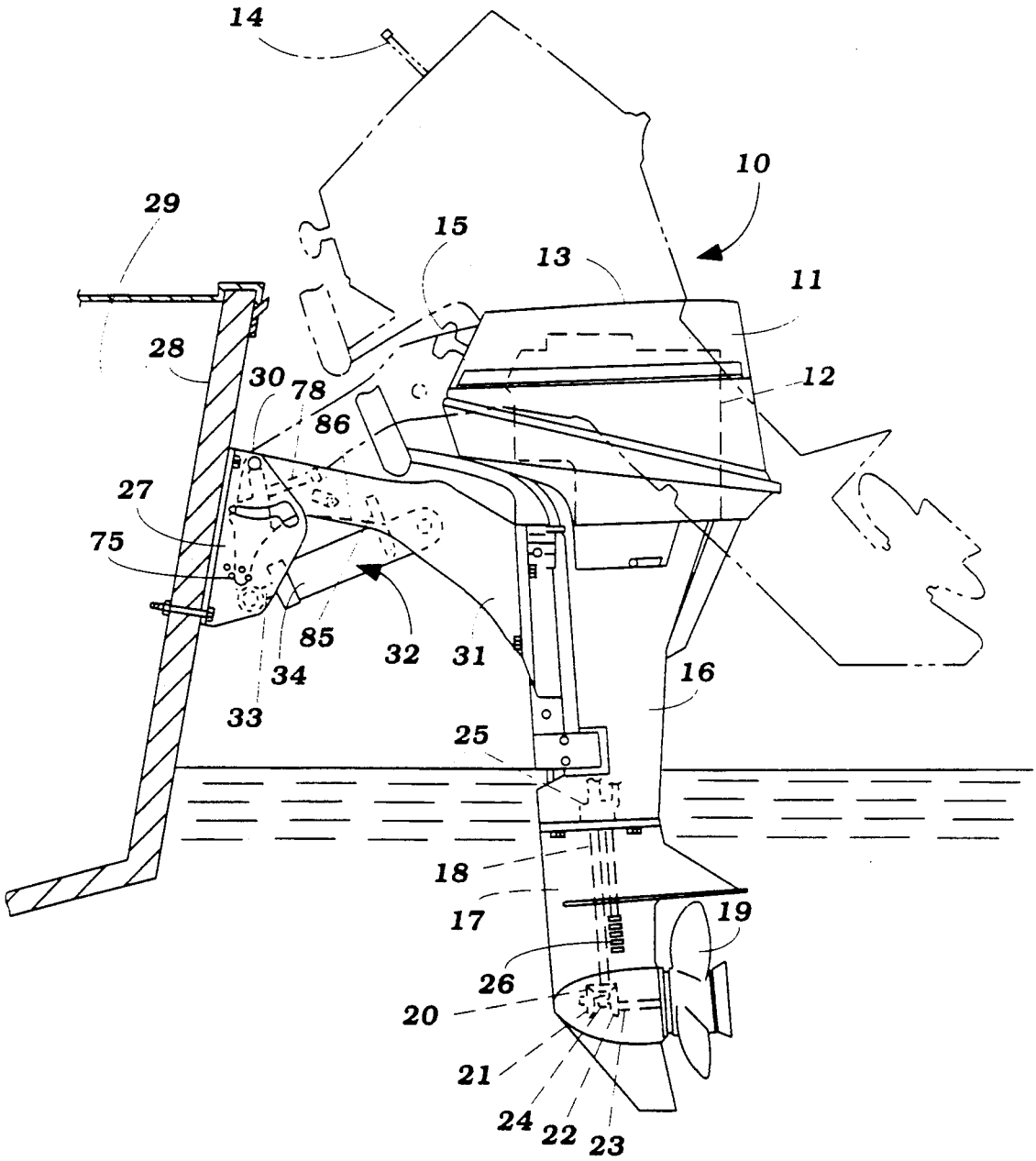
FIG. 1 is a left-side elevational view, cut away in part, and parts shown in section of an outboard drive unit and tilt handle embodying the invention.

FIG. 1 illustrates an outboard drive unit 10 having a power head 11 including an engine 12, a cowling 13, and a starter knob 15, a drive shaft housing 16, and a lower unit 17. The lower unit 17 includes a drive shaft 18 which is journaled within the lower unit 17 by means of a support bearing (not shown) and is driven at the upper end thereof by a the engine 12.

A forward, neutral, reverse transmission is positioned within the lower unit 17 for selectively driving a propeller 19 in forward or reverse directions. This forward, neutral, reverse transmission is comprised of a driving bevel gear 20 that is affixed to the lower end of the drive shaft 18. The driving bevel gear 20 is in mesh with a pair of counterrotating driven bevel gears 21 and 22 These driven bevel gears 21 and 22 are journaled upon an intermediate shaft (not shown) by means of spaced anti-friction bearings (not shown). The intermediate shaft is connected to the propeller shaft 23, which, in turn, is affixed to the propeller 19 by means of an elastic coupling. Supported on the intermediate shaft is a dog clutching sleeve 24 that has a splined connection to the intermediate shaft for rotation with this shaft and axial movement along it. The dog clutching sleeve 24 has oppositely facing dog clutching teeth that are adapted to cooperate with complementary dog clutching teeth formed on gears 21 and 22 for selectively coupling the gears 21 or 22 for rotation with the intermediate shaft.

The drive unit 10 is provided with a cooling system of the cooled type. The cooling system includes a circulating pump 25 that is driven by the engine 12 of the drive unit 10 in a suitable manner and which circulates coolant through the engine cooling jacket for discharge back into the body of water in which the watercraft is operating along with the exhaust gases from the engine. The cooling system further includes a water intake port 26 that is formed in the lower unit unit 17 of the drive unit 10 and which communicates with an internal passageway that is formed within the housing of the lower unit 17 by means of an integral passageway. The internal passageway communicates with the circulating pump 25 by means of a series of conduits.

The drive unit 10 also includes a clamp bracket 27 attached to the hull 28 of a marine vessel 29, a tilt shaft 30 and a swivel bracket 31 rotatably secured at one end to the tilt shaft 30 for movement of the drive unit 10 between a tilted-down position wherein the propeller 19 is positioned beneath the water to a tilted up position wherein the propeller 19 is out of the water. In order to facilitate this operation a tilt handle 14 is attached to the power head 11 and is used to move the drive unit 10 between the tilted-down position and the tilted up position.

The swivel bracket 31 is secured at the other end to the drive shaft housing 16 through a steering shaft for steering movement in a conventional manner.

The outboard drive unit 10 also includes a tilt cylinder device 32, having a rod 33 and a cylinder 34, secured at one end to the clamp bracket 27 and secured at the other end to the swivel bracket 31, to maintain the drive unit 10 in a downward position during normal operation but to permit the drive unit 10 to swing upwardly in the event of a collision with a submerged obstacle. Drive unit 10 is illustrated in solid lines in its down position, and in broken lines in its up or lifted position, in FIG. 1. The outboard drive unit 10 also includes a lower position stop pin 75 for deciding the downward position of the swivel bracket 31 for trim adjustment.

Figure 2:
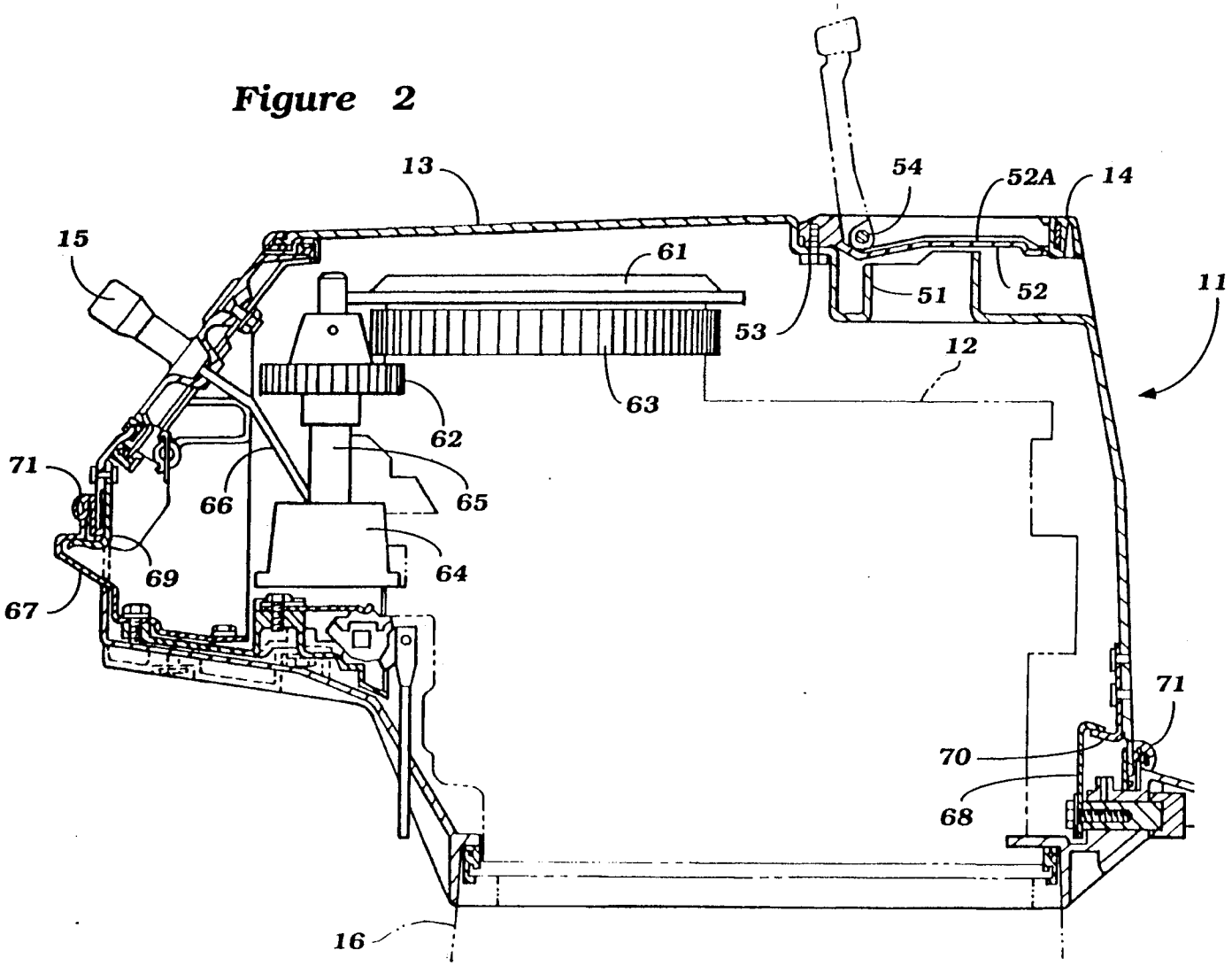
FIG. 2 is an enlarged cross-sectional view of the power head of an outboard drive unit showing the tilt handle and starter knob.

FIG. 2 shows the power head 11 including the cowling 13, the starter knob 15, and the tilt handle 14. The power head also includes an air intake port 51, an air intake port cover 52, and bolts 53 for securing the air intake port cover 52 to the rear portion of the cowling 13. The tilt handle 14 is rotatably supported about a support shaft 54 which is secured to the air intake port cover 52. The air intake port cover has a recessed portion 52A within which the tilt handle 14 is capable of being accommodated to provide a neat appearance when not in use.

A starting mechanism is positioned within the power head 11 for starting the engine 12. This starting mechanism cooperates with a fly wheel magneto section 61. The starting mechanism includes first and second starter gears 62 and 63, a rewind mechanism 64 and a starter shaft 65, engaged at one end to the rewind mechanism 64 for one-way rotation with the rewind mechanism 64. A rope 66 is attached to and coiled around the rewind mechanism 64 at one end and attached to the starter knob 15 at the other end.

The first starter gear 62 is supported on the starter shaft 65 for rotation with this shaft and axial movement along it. The first starter 62 gear has teeth that are selectively engageable with complimentary teeth formed on the second starter gear 63.

In order to start the drive unit 10, the operator pulls the starter knob 15. When the starter knob 15 is pulled, the rope 66 is drawn out of the power head 11 thereby causing the rewind mechanism 64 to engage the starter shaft 65 and cause it to rotate about a vertical axis. The rotation of the starter shaft 65 causes the first starter gear 62 to rotate and slide upward so that the teeth of the first starter gear engage the teeth of the second starter gear, causing the second starter gear 63 to rotate. The rotation of the second starter gear 63 causes the fly wheel magneto section 61 to rotate about a vertical axis. The first starter gear 62 includes a one-way clutch so as to accommodate the running of the engine. After the drive unit 10 is started, the operator releases the starter knob 15. The rope 66 is drawn into the power head 11 by the rewind action of the rewind mechanism 64.

First and second latches 67 and 68, and first and second keepers 69 and 70 selectively permit the cowling 13 to h=secured to or removed from the power head 11. The first keeper 69 is secured to the front portion of the cowling 13 and the second keeper 70 is secured to the rear portion of the cowling 13. The first latch 67 is attached to the front underside of the cowling 13 such that the first latch 67 may be engaged with, or disengaged from, the first keeper 69. Similarly, the second latch 68 is attached to the rear portion of the cowling 13 such that the second latch 68 may be engaged with, or disengaged from the second keeper 70. When the first latch 67 is engaged with the first keeper 69 and the second latch 68 is engaged with the second keeper 70, as shown in FIG. 2, the cowling 13 is secured to the power head 11. For easy maintenance of the drive unit by the operator, the drive unit may be tilt-up with the tilt handle 14, latches 67 and 68 disengaged from keepers 69 and 70 and the cowling 13 removed. The power head 11 further includes water tight gaskets 71, one at the front of the cowling 13 and one at the rear of the cowling 13.

Figure 3:
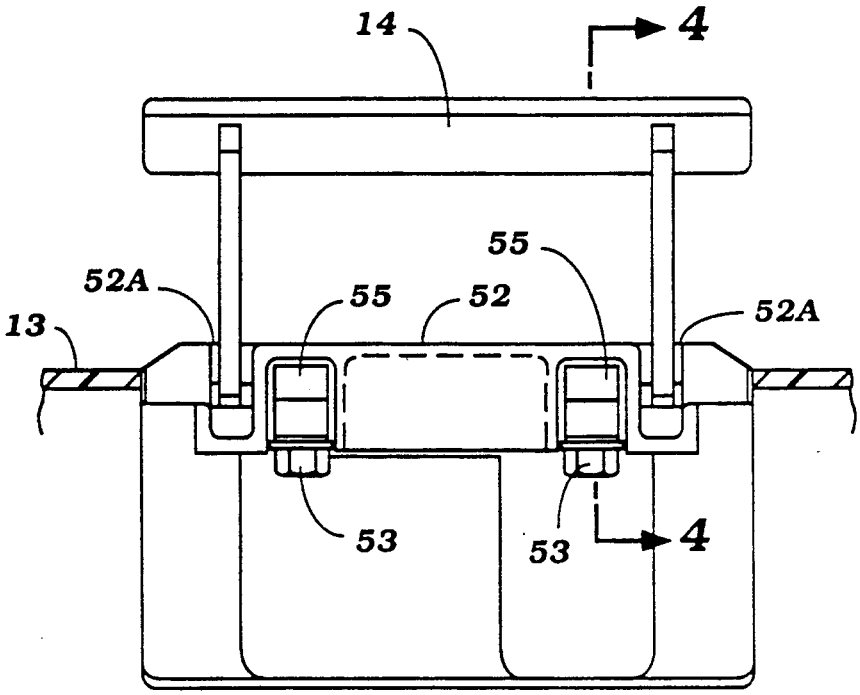
FIG. 3 is an enlarged detail view showing a tilt handle.
Figure 4:
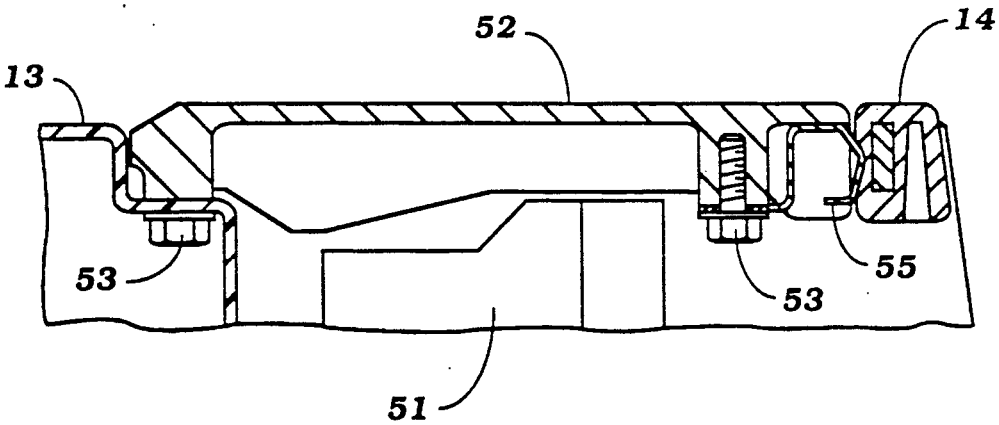
FIG. 4 is a cross-sectional view of the tilt handle, taken along line 4–4 of FIG. 3.

FIGS. 3 and 4 illustrate the details of the tilt handle 14 which is the preferred embodiment of the invention. The tilt handle 14 is rotatably supported about a support shaft 54 (see FIG. 2) for movement between an open or operative position as viewed in FIG. 3 and a closed or retracted position within the recessed portion of the air intake port cover 52A as viewed in FIG. 4. A spring member 55 engageable with the tilt handle 14 releasably retains the tilt handle 14 when it is positioned in the recessed portion of the air intake port cover 52A.

Figure 5:
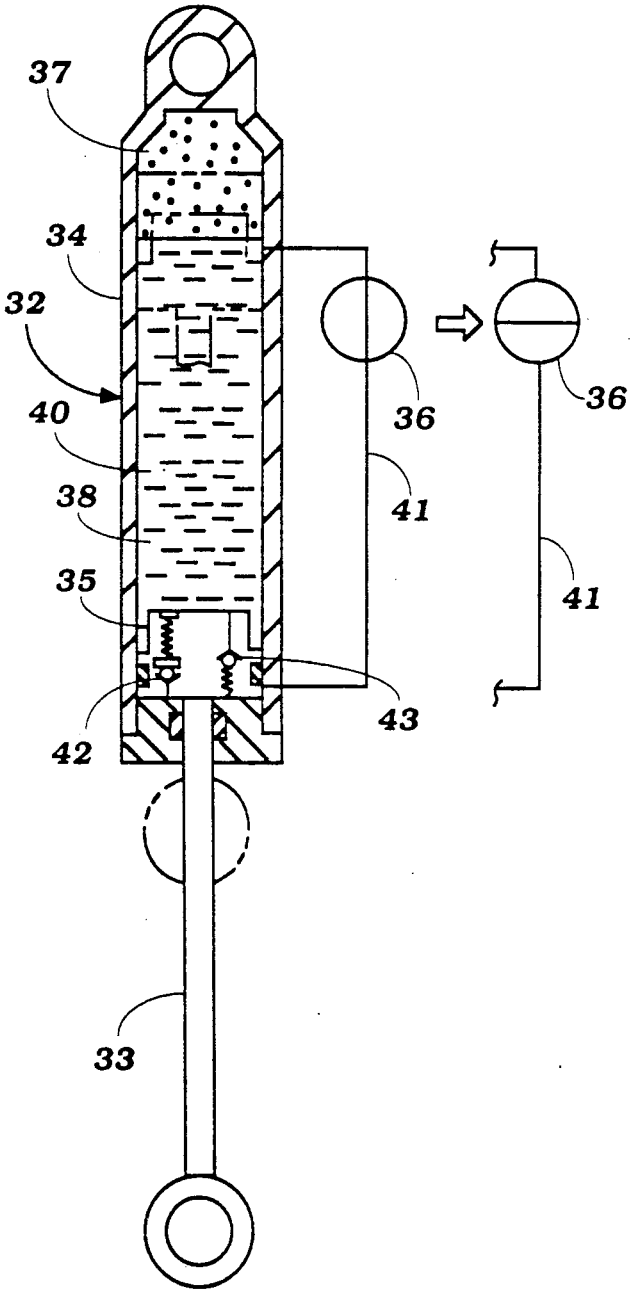
FIGS. 5 and 6 are schematic representations of a tilt cylinder.
Figure 6:
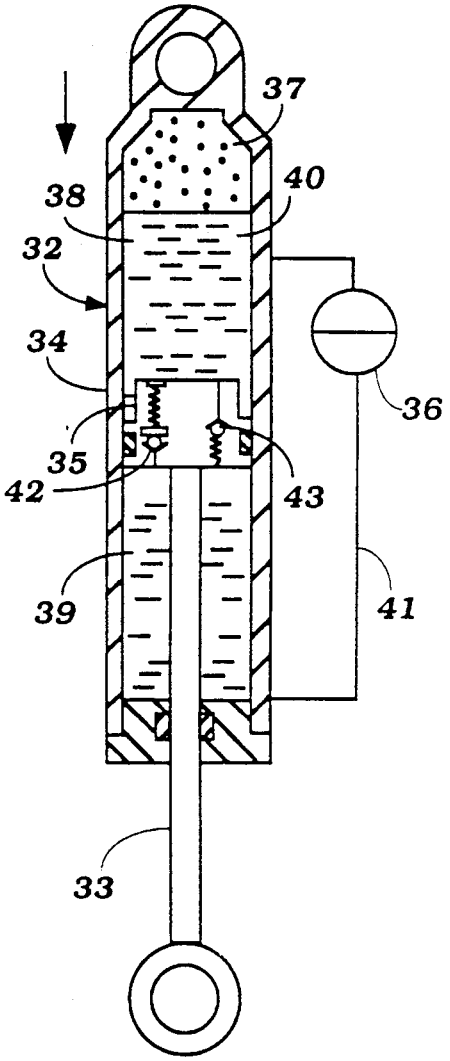

The function of the tilt cylinder device 32 is shown in FIGS. 5 and 6. When a piston 35 is fully retracted upwardly into the cylinder 34, a bypass valve 36 is closed, and an assist gas 37 is compressed, such as would occur when the drive unit 10 is lowered into its down or running position shown in solid lines in FIG. 1. In this condition, any rearwardly directed forces on the drive unit 10 such as those normally resulting from decelerating of the vessel or running the drive unit 10 in reverse would tend to urge the cylinder 34 in an upward direction relative to the rod 33 and the piston 35. Because the bypass valve 36 is closed, a working fluid 38 in an annular chamber 39 cannot flow bypass passage 41, and thus the downward force of the piston 35 causes the working fluid pressure in the annular chamber 39 to increase. However, the increased pressure in the annular chamber 39 resulting from such rearward forces on the drive unit 10 is not normally sufficient to open a first check valve 42. Therefore, the working fluid 38 in the annular chamber 39 is trapped, and any upward movement of the cylinder 34 relative to the piston 35 is resisted, thereby maintaining the drive unit 10 in its downward or running position.

When the operator has opened the bypass valve 36 so as to tilt the drive unit 10 upwardly to its lifted position, shown in broken lines in FIG. 1, for purposes of device or maintenance, the cylinder 34 is extended upwardly, thus reducing the volume of the annular chamber 39. The reduction in volume in the annular chamber 39 forces the working fluid 38 through the bypass passage into a cylindrical chamber 40.

If the drive unit 10 is tilted to its fully lifted position, the cylinder 34 moves upwardly such that the rod 33 and the piston 35 force virtually all of the working fluid 38 into the cylindrical chamber 40 as is illustrated in FIG. 5. The upward movement of the cylinder 34 is assisted by the pressure of the assist gas 37 to relieve the operator from the necessity of lifting the full weight of the drive unit 10. The pressure is not so high, however, to lift the drive unit 10 by itself. The assist gas 37 also expands to fill the volume of the cylinder 34 that is no longer occupied by the portion of the rod 33 that is extended out of the cylinder 34.

If the operator closes the bypass valve 36 while the rod 33 and the piston 35 are in an extended position and then releases the drive unit 10, the weight of the drive unit 10 exerts a force on the cylinder 34 in a downward direction relative to the piston 35. Such force is great enough to pressurize the cylindrical chamber 40 sufficiently to open a second check valve 43. The working fluid 38 is thus allowed to flow from the cylindrical chamber 40 through the second check valve 43 into the annular chamber 39, thereby allowing the rod 33 and the piston 35 to retract and dampingly lower the drive unit 10 to its down position. As the rod 33 and the piston 35 retract, the assist gas 37 is compressed to compensate for the volume of the cylinder 34 that is now occupied by the retracted rod 33.

In the event that the drive unit 10 collides with a submerged obstacle and the bypass valve 36 is closed, such a collision causes a sudden upward force on the cylinder 34, thereby increasing the working fluid pressure in the annular chamber 39 sufficient to open the first check valve 42. As a result, the working fluid 38 in the annular chamber 39 is forced through the first check valve 42 into the cylindrical chamber 40. The cylinder 34 extends upwardly, allowing the drive unit 10 to swing upwardly to prevent, or at least minimize, the impact damage to the drive unit 10. As the cylinder 34 extends upwardly, the assist gas 37 expands to compensate for the volume of the cylinder 34 formally occupied by the rod 33.

After the vessel has passed the submerged object and the drive unit 10 is released, the weight of the drive unit 10 urges the cylinder 34 downward relative to the piston 35, thus closing the first check valve 42 and pressurizing the cylindrical chamber 40 sufficiently to open the second check valve 43 as illustrated in FIG. 6. The working fluid 38 in the cylindrical chamber 40 is then forced through the second check valve 43 into the annular chamber 39, allowing the cylinder 34, to retract downwardly and dampenly return the drive unit 10 to its lowered or running position.

Figure 7:
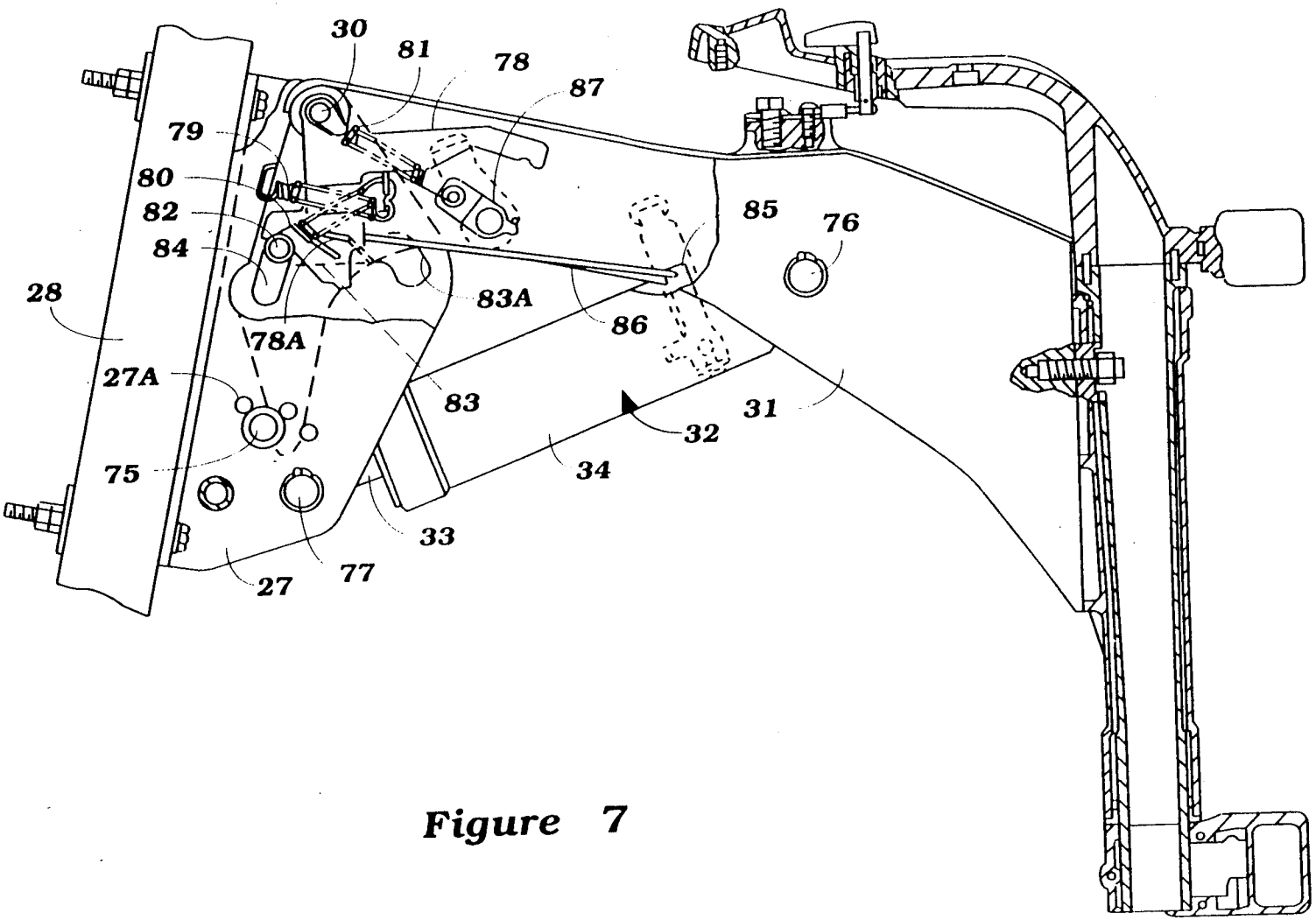
FIG. 7 is a side view, cut away in part, and parts shown in section showing a portion of the construction.

In FIG. 7, the clamp bracket 27 has a series of trim apertures 27A, 27B, 27C and 27D extending laterally therethrough for receiving a lower position stop pin 75 therein for deciding the downward or trim position of the swivel bracket 31. Thus, the angle of the drive unit 10 with respect to the hull 28 of the marine vessel 29 may be selectively varied by the operator in accordance with desired operating conditions merely by inserting the lower position stop pin 75 in the appropriate trim aperture 27A, 27B, 27C, or 27D, in the clamp bracket 27. The tilt cylinder device 32 extendably connects the clamp bracket 27 with the swivel bracket 31. The cylinder 34 of the tilt cylinder device 32 is pivotally secured to the swivel bracket 31 by a first connecting pin 76. The rod 33 of the tilt cylinder device 32 is pivotally secured to the clamp bracket 27 by a second connecting pin 77.

A tilt lock arm 78 is rotatably supported about the tilt shaft 30. First and second springs 79 and 80 are provided for rotating the lock arm 78 in a lock position when the swivel bracket 31 is in the tilted up position. When the lock arm 78 is in the lock position, an upper position stop pin 82, engageable with both a clamp bracket slot 83 and a swivel bracket slot 84, is engaged with a stop surface 83A of the clamp bracket slot 83 so that the swivel bracket 31 is prevented from moving. In such a case, the swivel bracket 31 is prevented from moving in the down direction by the action of the upper position stop pin 82. The swivel bracket 31 is prevented from moving toward the up direction by the closure of the bypass valve 36. A lever 85 is connected to the bypass valve 36 for opening and closing the bypass valve 36. A connecting link 86 extends between the lock arm 78 and the lever 85 so that the movement of the lock arm 78 to the lock position causes the bypass valve 36 to be closed.

A manual lever 87 and third spring 81 are provided for shifting the lock arm 78 from the lock position to a release position, thereby allowing the swivel bracket to be rotated to the tilted-down position. In this case, the connecting link 86 does not transmit the rotation of the lock arm 78 to the lower 85 because of a slot 78A positioned in the lock arm 78. Thus, the bypass valve 36 remains in the closed position when the swivel bracket 31 is in the tilted-down position. The swivel bracket 31 is prevented from moving toward the down direction by the action of the lower position stop pin 75 and toward the up direction by the closure of the bypass valve 36.

The foregoing descriptions represent merely exemplary embodiments of the invention. Furthermore, although the invention is described herein within the context of outboard marine drive units, the invention is not limited to such an application. One reasonably skilled in the art will readily recognize that the invention is equally applicable to other apparatus or systems having tiltable or pivotable articulated elements. Finally, various changes or modifications may be made in said embodiments without departing from the spirit or scope of the invention.

I claim:

1. An outboard drive unit comprising a power head and propelling means for propelling a marine vessel having a hull through the water, said outboard drive unit further comprising a clamp bracket attached to the hull of said vessel, a tilt shaft positioned outside of the hull, a swivel bracket rotatably secured to said clamp bracket by said tilt shaft for movement about a generally horizontally extending tilt axis through a small tilt angle between a tilted-down position wherein the propelling means is positioned beneath the water and a tilted-up position wherein the propelling means is out of the water but the power head of said outboard drive unit does not intrude into said vessel beyond the hull, said swivel bracket extending rearwardly and generally horizontally when in the tilted-down position, said outboard drive unit further comprising a tilt handle secured to the power head of said outboard drive unit for movement from a recessed position on the power head to an operative position accessible to an operator for imparting movement of said outboard drive unit about the generally horizontally extending tilt axis.

2. An outboard drive unit as recited in claim 1, wherein said power head includes a starter knob.

3. An outboard drive unit as recited in claim 2, wherein said tilt handle is capable of imparting movement to said outboard drive unit about the generally horizontally extending tilt axis such that the power head including the starter knob is capable of being positioned near the hull of said vessel for easy maintenance and operation.

4. An outboard drive unit as recited in claim 3, wherein said power head of said outboard drive unit further comprises a cowling, an air intake port, an air intake port cover to which said tilt handle is secured, and means for securing said cover to said cowling.

5. An outboard drive unit as recited in claim 3, wherein said power head of said outboard drive unit further comprises a support shaft secured to said cover, said tilt handle being rotatably supported about said support shaft.

6. An outboard drive unit as recited in claim 4, wherein said securing means comprises bolts.

7. An outboard drive unit as recited in claim 6, wherein said cover has a recessed portion within which said tilt handle is capable of being accommodated when in its recessed position.

8. An outboard drive unit as recited in claim 7, further comprising a spring member engageable with said tilt handle for preventing free movement of said tilt handle when it is positioned in the recessed portion of said cover.

9. An outboard drive unit as recited in claim 5, wherein said securing means comprises bolts.

10. An outboard drive unit as recited in claim 9, wherein said cover has a recessed portion within which said tilt handle is capable of being accommodated when in its recessed position.

11. An outboard drive unit as recited in claim 10, further comprising a spring member engageable with said tilt handle for preventing free movement of said tilt handle when it is positioned in the recessed portion of said cover.

12. An outboard drive unit as recited in claim 1, further comprising a tilt cylinder device secured at one end to said clamp bracket and secured at the other end to said swivel bracket for assisting in tilting up of said drive unit.

13. An outboard drive unit comprising a power head and propelling means for propelling a marine vessel having a hull through the water, said power head further comprising a cowling, an air intake port, an air intake port cover and a support shaft secured to said cover, said outboard drive unit further comprising a clamp bracket attached to the hull of said vessel, a tilt shaft, a swivel bracket rotatably secured to said clamp bracket by said tilt shaft for movement about a generally horizontally extending tilt axis through a small tilt angle between a tilted-down position and a tilted-up position, said outboard drive unit further comprising a tilt handle rotatably supported about said support shaft at the rearward portion of said outboard drive unit for movement from a recessed position to an operative position accessible to ann operative for imparting movement of said outboard drive unit about the generally horizontally extending tilt axis.

14. An outboard drive unit as recited in claim 13, wherein said cover has a recessed portion within which said tilt handle is capable of being accommodated when in its recessed position.

15. An outboard drive unit as recited in claim 14, further comprising a spring member engageable with said tilt handle for preventing free movement of said tilt handle when it is positioned in the recessed portion of said cover.

16. An outboard drive unit as recited in claim 15, further comprising means for securing said cover to said cowling.

17. An outboard drive unit as recited in claim 13, further comprising a tilt cylinder device secured at one end to said clamp bracket and secured at the other end to said swivel bracket for assisting in tilting up of said drive unit.

* * * * *